US006352321B1

(12) United States Patent
Muñoz

(10) Patent No.: US 6,352,321 B1
(45) Date of Patent: Mar. 5, 2002

(54) DEVICE FOR STORING, TRANSPORTING AND DISPLAYING MINIATURE FIGURES

(75) Inventor: Alberto Merino Muñoz, Sant Adria de Besos (ES)

(73) Assignee: Ta & Te Condensacion de Suenos, S.L., L'Ametlla del Valles (ES)

( * ) Notice: Subject to any disclaimer, the term of this patent is extended or adjusted under 35 U.S.C. 154(b) by 0 days.

(21) Appl. No.: 09/445,048

(22) PCT Filed: Mar. 9, 1999

(86) PCT No.: PCT/ES99/00058

§ 371 Date: Dec. 1, 1999

§ 102(e) Date: Dec. 1, 1999

(87) PCT Pub. No.: WO99/45826

PCT Pub. Date: Sep. 16, 1999

(30) Foreign Application Priority Data

Mar. 9, 1998 (SG) ..... 9800647

(51) Int. Cl.[7] ..... A47F 3/14

(52) U.S. Cl. ..... 312/119; 312/126; 206/564; 446/73

(58) Field of Search ..... 312/114, 119, 312/126, 127, 128, 129, 130, 311; 40/1; 446/476, 73, 72; 206/564

(56) References Cited

U.S. PATENT DOCUMENTS

| | | | | | |
|---|---|---|---|---|---|
| 834,452 | A | * | 10/1906 | Beiser | 206/564 |
| 1,423,078 | A | * | 7/1922 | Carlson | 206/564 X |
| 1,480,427 | A | * | 1/1924 | Underwood | 206/564 |
| 2,138,560 | A | * | 11/1938 | Stuart | 312/311 |
| 2,156,351 | A | * | 5/1939 | Paul | 40/324 |
| 3,306,689 | A | * | 2/1967 | Isaacson et al. | 312/128 X |
| 3,481,657 | A | * | 12/1969 | Farrall et al. | 206/564 X |
| 3,849,930 | A | * | 11/1974 | Stubbmann | 446/137 |
| 4,489,994 | A | * | 12/1984 | Williams | 312/119 |
| 4,650,077 | A | * | 3/1987 | Droz | 206/564 X |
| 5,013,278 | A | * | 5/1991 | Dixon et al. | 446/73 |
| 5,048,902 | A | * | 9/1991 | Daly | 312/311 X |
| 5,358,692 | A | * | 10/1994 | Reynolds | 206/564 X |
| 5,706,966 | A | * | 1/1998 | Rothe | 206/564 X |
| 6,047,701 | A | * | 4/2000 | Feldman | 206/564 X |

* cited by examiner

*Primary Examiner*—Peter V. Cuomo
*Assistant Examiner*—Hanh V. Tran
(74) *Attorney, Agent, or Firm*—Michael J. Striker

(57) ABSTRACT

The device comprises platforms which are intended to place the miniature figures in guides designed to receive the dovetailed bases of the figures. With the disclosed device, it is possible to store collections of figures and further decorate the assembly.

4 Claims, 3 Drawing Sheets

DEVICE FOR STORING, TRANSPORTING AND DISPLAYING MINIATURE FIGURES

OBJECT OF THE INVENTION

The present invention relates, as indicated by the title, to a device whose aim is to act as a support for miniature figures, in such a way that these are attached to the support in a slightly spaced fashion, preventing them from coming into contact with one another and deteriorating: said device can be used for transporting, displaying and storing such miniature figures or pieces.

BACKGROUND OF THE INVENTION

Currently there are a considerable number of people whose hobby is collecting series or groups of elements, the collections often being of miniature figures, such as lead soldiers or similar.

These figures are delicate because, as well as faithfully representing features, clothing and other identifying characteristics, they are painted. Thus a small knock serves to deteriorate them in almost irreparable fashion.

The figures in question comprise a support base, fixed or removable, that allows the collector to arrange them in a certain position. However, this poses an important problem when it comes to transporting or storing them because, as has been mentioned, they can deteriorate easily.

To prevent this deterioration the collectors are accustomed to protecting the figures with different elements, such as sponge layers, paper, clothe, etc.

DESCRIPTION OF THE INVENTION

To solve the problems posed the device object of the present invention has been thought up. This comprises a platform provided with means for mounting and supporting the miniature figures by their bases and a box or cabinet which, in turn has some means for coupling different platforms.

In accordance with the invention the means defined in the platform for placing the figures will be composed of guides of suitable size and form to allow the bases of the figures in question to be introduced inside with a tight fit and in a sliding fashion.

Said guides can be open at both ends or at one end only. The device may also include some practical stops for closing or blocking the open ends of the guides, preventing the figures placed in the guide from coming loose by accident.

It is also foreseen that the platforms can be given a surface finish imitating sand, grass, snow or any element that may constitute a suitable decoration for the display of miniature figures.

The sides of said platforms can take the form of a dovetail that allow different platforms to be coupled and a display surface of the desired size to be obtained.

The box or cabinet mentioned hereinabove can be used both as a container for transport or storage of the pieces or as a display therefor.

The means defined inside the box for putting the platforms in place will be composed of some male guides and/or female guides facing one another, in a suitable configuration to support them. These guides will preferably be aligned in parallel and will be very close together so that the user may place the platforms at the desired separation, in function of the height of the figures placed on these platforms.

DESCRIPTION OF THE DRAWINGS

To complete the description being given here and with a view to facilitating a better understanding of the characteristics of the invention the present specification is accompanied, for descriptive purposes, and as an integral part thereof, by a set of drawings, in which, for illustrative purposes and not limiting, the following has been represented.

PREFERRED EMBODIMENT OF THE INVENTION

As can be observed in the figures to which reference is made, the device object of the invention comprises a box or glass cabinet (1) and a series of platforms (2) for placing miniature figures (3).

The glass cabinet (1) is provided with some doors (1*a*) and defines in its inside some compartments (1*b*), the facing sides being provided with guides (1*c* and 1*d*) for putting the platforms in place (2)

Figure 1:
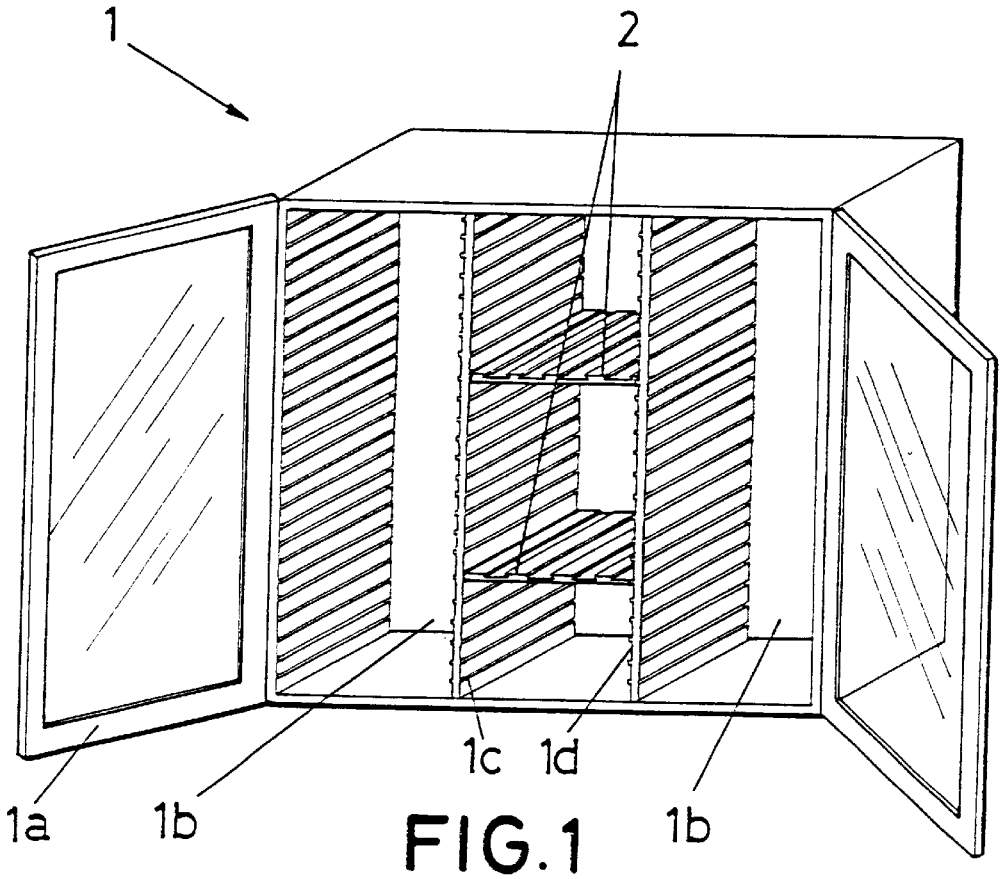
FIG. 1 shows a schematic perspective view of the device object of the invention represented by a glass cabinet and two platforms mounted over the guides defined therein.
Figure 2:
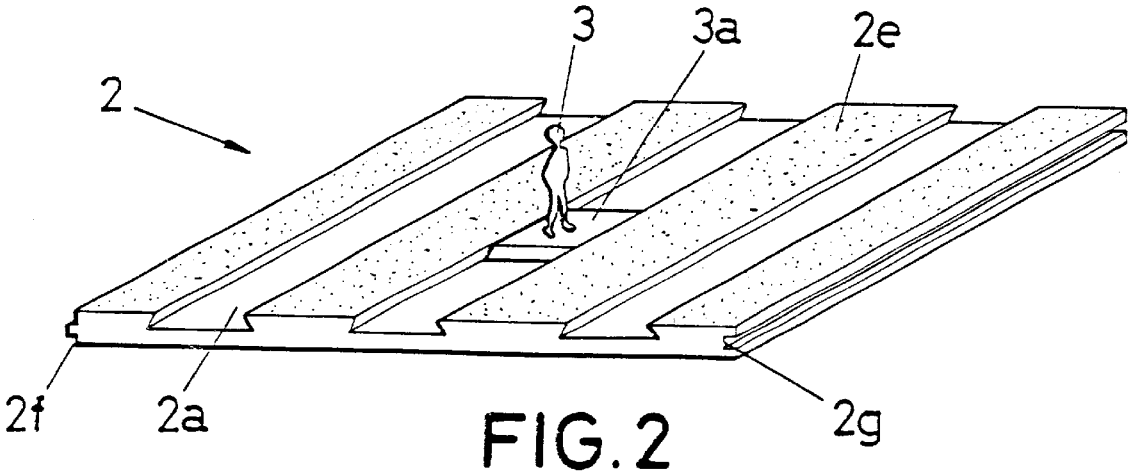
FIG. 2 shows a perspective view of a platform provided with open guides for mounting the miniature figures and a dovetail on two opposite sides; with a miniature figure represented on one of the guides.
Figure 3:
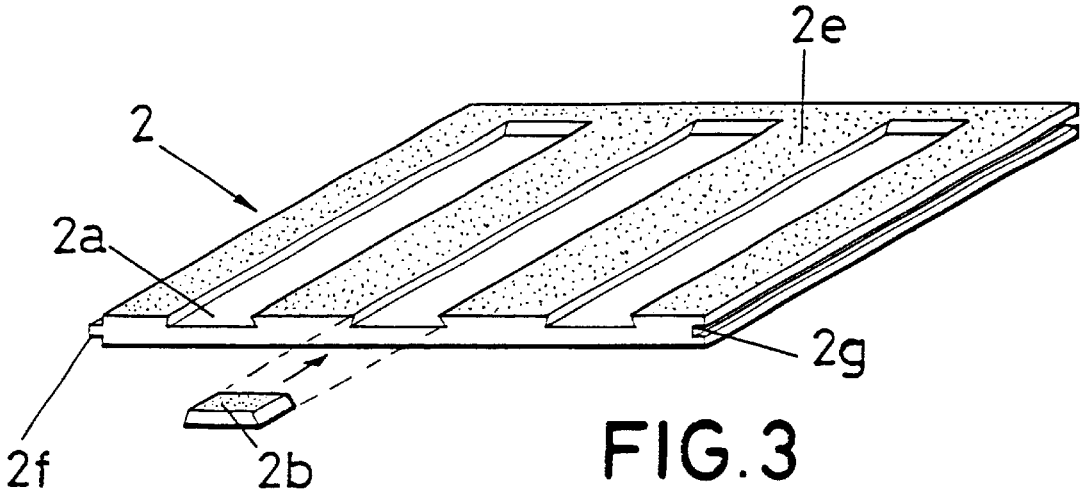
FIG. 3 shows a plan view of an embodiment of the platform, provided in this case with some guides closed at one end and some stops that can be coupled to the open end of the guides.
Figure 4:
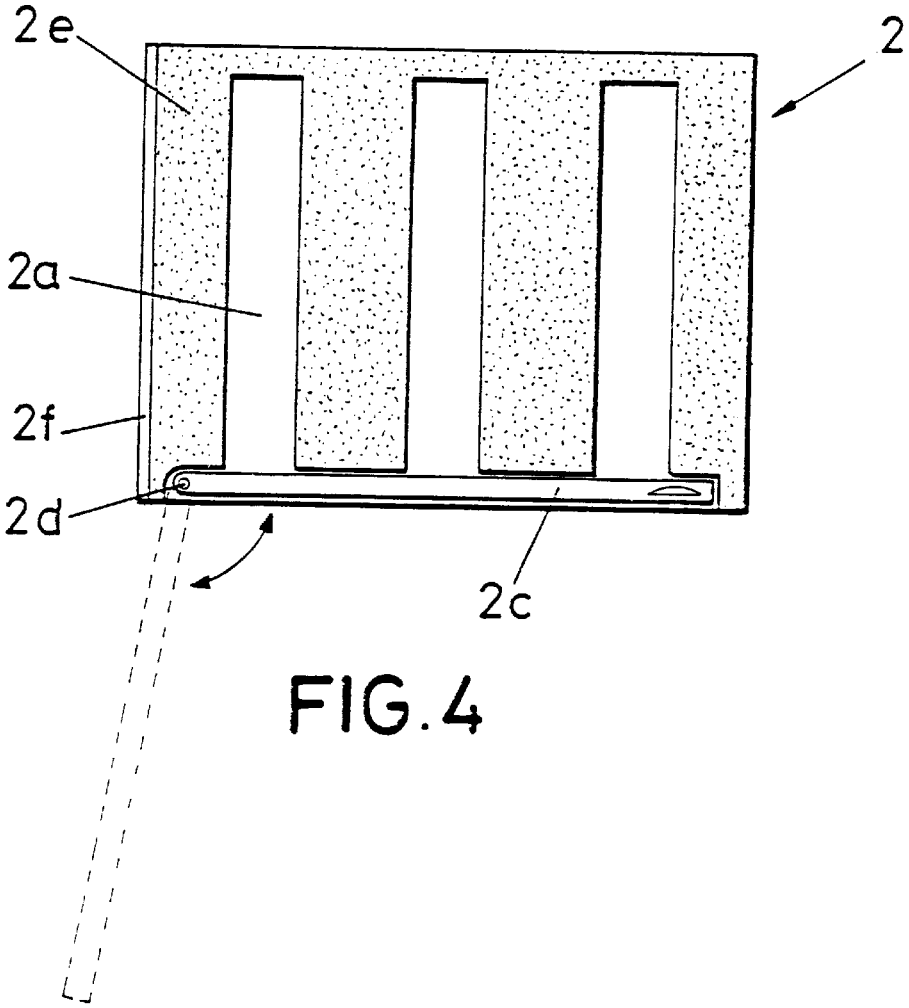
FIG. 4 shows a plan view of an embodiment of the platform in which the stop used to block the open ends of the guides is composed of an arm which can be folded open laterally.
Figure 5:
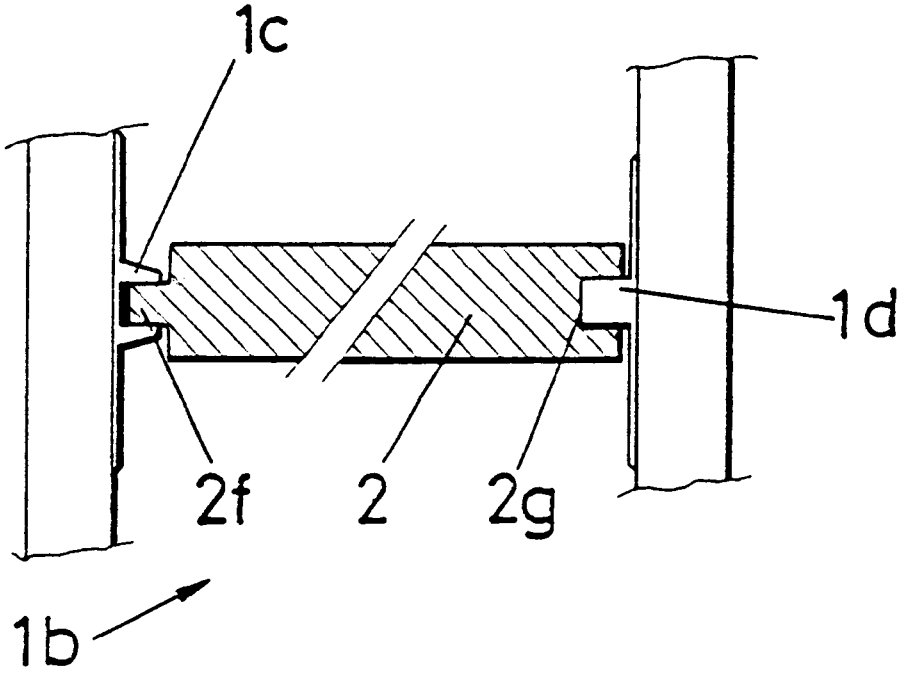
FIG. 5 shows an example of an embodiment of the guides defined inside the glass cabinet, and of one of the platforms coupled thereto by means of the dovetail arrangement.
Figure 6:
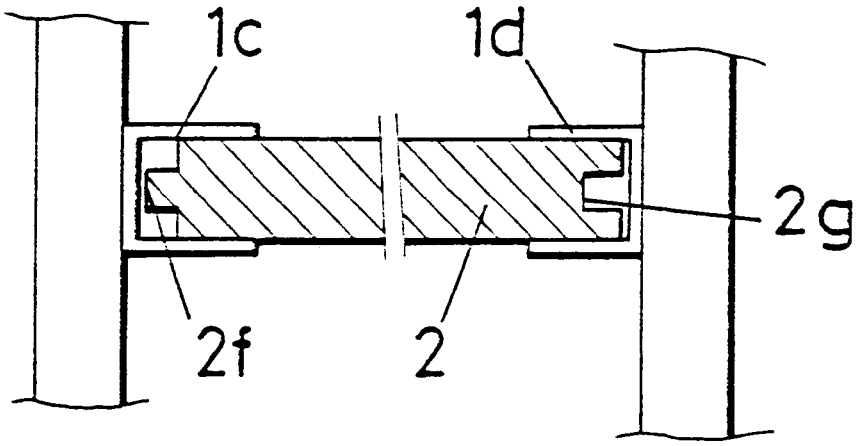
FIG. 6 shows an embodiment of the guides of the glass cabinet that, in this case, embrace opposite sides of the platform.

The platforms (2) have guides on their upper surface (2*a*) destined to receive inside, in sliding fashion, the bases (3*a*) of the figures (3). As can be seen in FIGS. 2, 3 and 4, the guides (2*a*) can be open at both ends or open at only one end. In the latter of these cases the device will comprise some stops designed to close or block the open ends of the guides (2*a*) in order to prevent the figures (4) mounted therein from falling out accidentally. Said stops may be constituted by some pieces (2*b*) which are introduced fitting tightly in the free ends of the guides (2*a*) or by a folding arm (2*c*) associated to the platform (2) by means of a spin axis (2*d*); the arm (2*c*) and platform (2) will have a complementary projection and groove which join together by pressure when said arm is in closed position, holding the arm in this position.

The pieces (2*b*) can also be used as separator elements if the need arises, being placed between the bases (4*a*) of the figures (4) mounted on the same guide (2*a*).

The upper surface of the platform (2) may be finished (2*e*) in such a way as to imitate sand, as is represented in the example of FIG. 2, grass or any other element in accordance with the characteristics of a particular type of figure, such that the platform itself constitutes a suitable decoration for display of the figures.

It has been foreseen that the platforms (2) can have in two or in all four opposing sides some complementary guides (2*f* and 2*g*) that allow the dovetail joining of several platforms (2) thus obtaining a greater surface area for figure display.

The guides (1*c* and 1*d*) located on opposing sides of the compartments of the glass cabinet can be complementary to the guides (2*f* and 2*g*) forming the dovetail of the platforms or they may simply form a "C" section, sufficiently big to embrace the opposing sides of said platforms (2)

With this arrangement of elements the figures (3) can be associated with the platforms (2) by means of introducing the bases (3*a*) into the guides (2*a*) , with the platform itself acting as a display for the figures.

In turn the platforms (2) can be mounted on guides (1*c* and 1*d*) defined on the inside of the glass cabinet, with the figures (3) protected independently of whether they are exposed, stored or have to be transported.

It is not considered necessary to make this description more extensive in order for anyone skilled in the art to understand the scope of the invention and the advantages that are derived therefrom.

The materials, form, size and arrangements of the elements will be susceptible to variation provided this does not lead to a change in the essential characteristics of the invention, which is claimed hereinafter.

What is claimed is:

1. A device for storing, transporting and displacing miniature figures, comprising a container formed as a box or a glass cabinet and having a plurality of walls facing each other and provided with container guides extending in a longitudinal direction, along a whole lengths of said walls; a plurality of platforms extending transversely to said walls of said container and mountable in said container and having platform guides at opposite sides which are complementary to said container guides so as to guide said platforms in said container, said platform guides extending in said longitudinal direction over the whole length of said platforms, said platform guides being formed so that at least one platform guide of one of said platforms is complementary to at least one of said platform guides of another of said platforms; figure guides provided in each of said platforms and designed for receiving in sliding fashion a base of the figures, said figure guides extending also in said longitudinal direction, said container guides, said platform guides, and said figure guides having a uniform cross-section in said longitudinal direction, being spaced from one another in a transverse direction extending in said longitudinal direction, and being parallel to each another.

2. A device as defined in claim 1, wherein said platforms have an upper surface provided with a finish selected from the group consisting of sand, grass, and snow.

3. A miniature figures storing, transporting, and displacing set comprising a plurality of miniature figures each having a base; and a device for storing, transporting, and displacing miniature figures, said device including a container formed as a box or a glass cabinet and having a plurality of walls facing each other and provided with container guides extending in a longitudinal direction, along a whole lengths of said walls; a plurality of platforms extending transversely to said walls of said container and mountable in said container and having platform guides at opposite sides which are complementary to said container guides so as to guide said platforms in said container, said platform guides extending in said longitudinal direction over the whole length of said platforms, said platform guides being formed so that at least one platform guide of one of said platforms is complementary to at least one of said platform guides of another of said platforms; figure guides provided in each of said platforms and designed for receiving in sliding fashion a base of the figures, said figure guides extending also in said longitudinal direction, said container guides, said platform guides, and said figure guides having a uniform cross-section in said longitudinal direction being spaced from one another in a transverse direction, extending in said longitudinal direction and being parallel to each another.

4. A miniature figures as defined in claim 3, wherein said platforms have an upper surface provided with a finish selected from the group consisting of sand, grass, and snow.

* * * * *